United States Patent [19]

Ridenour

[11] Patent Number: 4,591,098

[45] Date of Patent: May 27, 1986

[54] APPARATUS FOR PRODUCING AERATED WATER

[76] Inventor: Ralph G. Ridenour, 626 Lexington-Ontario Rd., Mansfield, Ohio 44903

[21] Appl. No.: 518,821

[22] Filed: Aug. 1, 1983

[51] Int. Cl.[4] ..... B05B 1/28; B05B 1/26

[52] U.S. Cl. ..... 239/288.3; 239/428.5; 239/499

[58] Field of Search ..... 239/428.5, 288, 288.3, 239/589, 457, 458, 460, DIG. 18, 499; 261/DIG. 22; 137/379, 801; 222/566

[56] References Cited

U.S. PATENT DOCUMENTS

| | | | |
|---|---|---|---|
| 2,423,960 | 7/1947 | Bucknell et al. | 239/DIG. 18 |
| 2,565,554 | 8/1951 | Goodrie | 239/428.5 |
| 2,633,343 | 3/1953 | Aghnides | 239/428.5 |
| 2,888,209 | 5/1959 | Hjulian | 239/428.5 |
| 3,012,733 | 12/1961 | Allenbaugh | 239/458 |
| 3,322,352 | 5/1967 | Alcantara | 239/428.5 |
| 4,013,230 | 3/1977 | Gondek | 239/499 |
| 4,082,225 | 4/1978 | Haynes | 239/428.5 |
| 4,422,191 | 12/1983 | Jaworski | 239/428.5 |
| 4,426,040 | 1/1984 | Smith | 239/428.5 |

FOREIGN PATENT DOCUMENTS

| | | | |
|---|---|---|---|
| 1161496 | 8/1969 | United Kingdom | 239/288.5 |

*Primary Examiner*—Andres Kashnikow
*Assistant Examiner*—Patrick N. Burkhart
*Attorney, Agent, or Firm*—Pearne, Gordon, Sessions, McCoy, Granger, Tilberry

[57] ABSTRACT

Apparatus in the form of a shower head to aerate water is disclosed. An uninterrupted and uniform spray pattern is achieved by utilizing a terminating wall for the coaxial aperture of the nozzle and an end wall for the nozzle downstream of the terminating wall. The terminating wall is separated from the end wall by an annular moat and is radially inboard and upstream from the end wall so that it is physically protected against damage, especially at the annular intersection between the coaxial aperture and the end wall. This annular intersection is made a very sharp angle, chamfered no more than 0.003 inch, to achieve this uniform spray pattern, yet the end wall downstream thereof protects it against physical damage to maintain this uniform spray pattern and to protect the user of the shower head against injury from cuts.

10 Claims, 3 Drawing Figures

APPARATUS FOR PRODUCING AERATED WATER

BACKGROUND OF THE INVENTION

The prior art has shown apparatus for producing aerated water for use in a shower head or a kitchen sink faucet, with both being shown in U.S. Pat. No. 2,565,554 by Joseph J. Goodrie, issued Aug. 28, 1951. Some aerating devices have had the air inlets adjacent a perforated disc, as in the Goodrie patent or in U.S. Pat. No. 2,633,343 to Elie P. Aghnides, issued Mar. 31, 1953. Some shower heads have had a spray pattern defined by a plurality of apertures adjacent a chamfered edge of the shower head. Such is illustrated in U.S. Pat. No. 3,322,352 by Jose M. A. Alcantara, issued May 30, 1967. Other shower heads have had diverging streams of water in a shower head, with the shower head having a rounded inner corner. Such construction is shown in U.S. Pat. No. 4,013,120 to John T. Gondek, issued Mar. 22, 1977. A further aerating type of shower head had an outlet aperture with a plurality of conical steps or a cylindrical outlet aperture with a step. This was shown in U.S. Pat. No. 4,082,225 to Kenneth H. Haynes, issued Apr. 4, 1978.

It has been observed that the typical shower head had a chamfered or rounded edge for ease of production and also for protection to the user. A person using a shower head often wishes to take hold of it to adjust the direction of the shower spray, and if sharp edges are present, they may be a possible source of cuts to the hand of the user. Also, during manufacturing or during use, the edges of the shower head might become nicked or scratched, and it has been determined that this disrupts the shower spray pattern from its normal uniform pattern. Such a nick could cause the water to creep back on the outside edge of the spray head, according to Bernoulli's theorem, because the flow pattern of the water leaving the exit end of the spray head was disrupted.

SUMMARY OF THE INVENTION

Accordingly, the problem to be solved is how to construct an apparatus for aerating water, as in a sink faucet or shower head, wherein a uniform spray pattern will be achieved without any anomolies or disruptions and, also, the shower head will have exposed edges which are rounded for safety and for ease of manufacture without nicks and scratches.

This problem is solved by an apparatus for producing aerated water comprising, in combination, a body having a longitudinal axis and having water inlet and downstream ends, a coaxial aperture extending to the downstream end of said body, restrictor means upstream of said coaxial aperture and having a cross-sectional area for water less than the cross-sectional area of said coaxial aperture, said body having an annular outer wall surrounding said coaxial aperture, an end wall of said body contiguous with said outer wall, a terminating wall at the downstream end of said coaxial aperture and recessed upstream from said end wall, an annular moat surrounding said terminating wall and extending between said terminating wall and said end wall, and the intersection between said terminating wall and said coaxial aperture being a sharp angle and being physically protected from damage by being recessed upstream from said end wall.

Accordingly, an object of the invention is to provide an apparatus for aerating water which has a uniform spray pattern of aerated water.

Other objects and a fuller understanding of the invention may be had by referring to the following description and claims, taken in conjunction with the accompanying drawing.

DESCRIPTION OF THE PREFERRED EMBODIMENT

Figure 1:
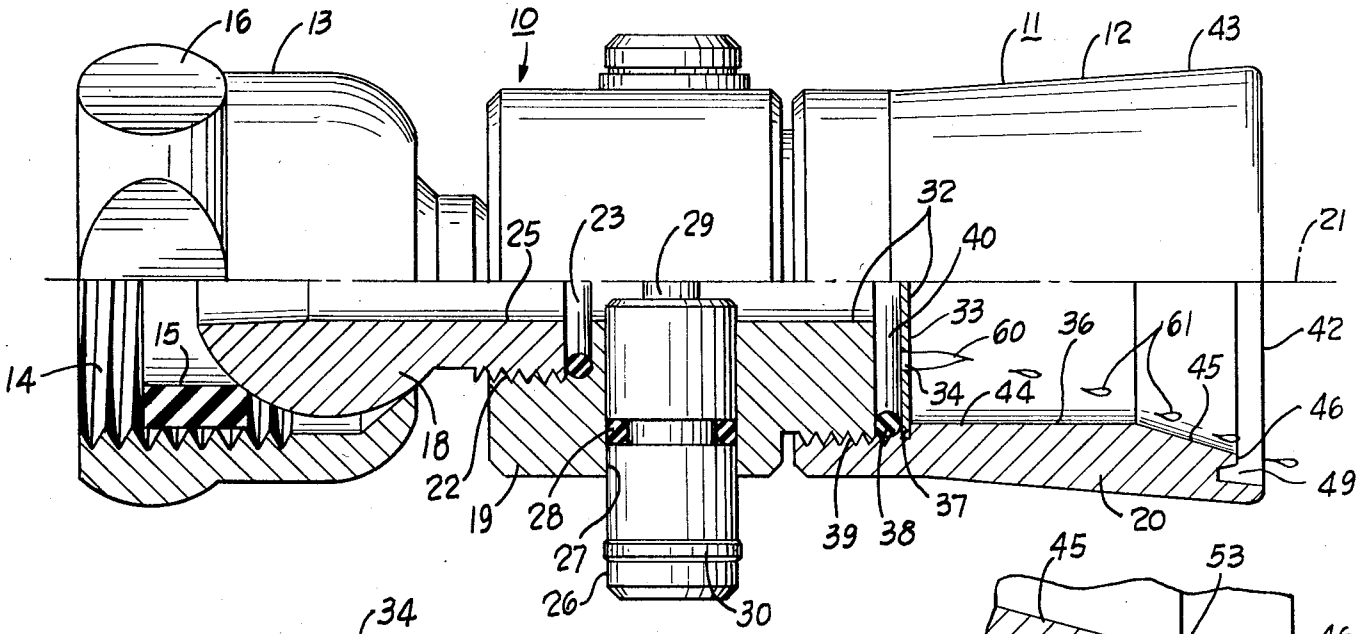
FIG. 1 is a longitudinal view, partly in section, of an aerating apparatus according to the invention.
Figure 3:
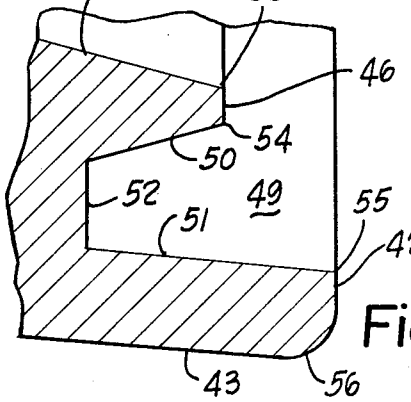
FIG. 3 is an enlarged, partial view of the downstream end of the body.

The drawing illustrates an apparatus 10 for producing aerated water. This apparatus may be in the form of a sink faucet or attachment to a kitchen sink faucet to aerate the water stream, or, as shown, it may have an outlet end in the form of a shower head 11. The apparatus 10 includes generally a body 12 and a connector 13. The connector 13 has internal threads 14 and a gasket 15 to permit watertight connection to a water supply pipe (not shown). The connector 13 is provided with a hexagonal wrench pad 16, so that a tool may be used to tighten the connector onto the supply pipe. The connector provides a socket connection for a ball 18 which is one of three parts of the body 12. The body 12 is made in three parts for ease of manufacture; the other two parts of the body 12 include a central portion 19 and a nozzle portion 20. The body 12 has a longitudinal axis 21 and the water flow is longitudinally through this body 12.

The ball 18 of the body 12 is secured to the central portion 19 by a threaded connection 22 and sealed by an O-ring 23. A central aperture 25 extends through the ball 18 and through the central portion 19, and a plug valve 26 is provided in a cross bore 27 and sealed by O-rings 28 to selectively reduce the flow of water through the central aperture to save water. When the plug valve 29 is in the position shown, a narrow neck 29 unitary with the plug valve 26 permits normal water flow. When the plug valve 26 is moved upwardly to an alternate position whereat a snap ring 30 engages the central portion 19, the water flow is reduced considerably, yet some water is kept flowing to maintain the temperature of the shower water.

Figure 2:
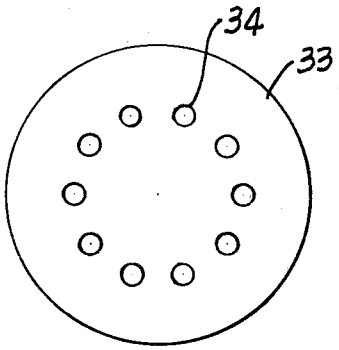
FIG. 2 is an elevational view of an apertured disc within the apparatus.

Restrictor means 32 is provided in the body 12, and this restrictor means includes the central aperture 25 and an apertured disc 33. This disc has longitudinally directed apertures 34, there being ten in number in the preferred embodiment as shown in FIG. 2. The nozzle 20 has an enlarged coaxial aperture 36 downstream from the disc 33, and the disc 33 is trapped between a shoulder 37 and an O-ring 38 when the nozzle 20 is threaded onto the central portion 19 at a threaded connection 39. The restrictor means 32 includes not only the central aperture 25 and apertured disc 33, but also the longitudinal space 40 immediately upstream from the disc 33. It is considered that this restrictor means, restricting the cross-sectional area of the water flow passageway, and then the plural streams of water from the apertures 34 entering into the enlarged cross-sectional area of the coaxial aperture, is that which creates a partial vacuum in the nozzle 20. In the embodiment shown, air is drawn into the interior of this nozzle from the downstream end wall 42 of the body nozzle 20. The body nozzle has an annular outer wall 43 surrounding the coaxial aperture 36 and contiguous with the end wall 42. In this preferred embodiment, the coaxial aperture 36 has a cylindrical boundary wall 44 immediately downstream of the disc 33 and then merges into a conical extension 45 to terminate at a terminating wall 46. An annular moat 49 surrounds the terminating wall 46 and extends between this terminating wall and the end wall 42. This annular moat is defined by an inner wall 50, an outer wall 51, and a bottom wall 52. The annular intersection 53, where the coaxial aperture 36 intersects the terminating wall 46, should be made as sharp as possible, not more than 0.003 inch chamfer or radius, and preferably not more than 0.001 inch. The outer annular intersection 54 between the terminating wall 46 and the moat inner wall 50 also should be a sharp corner. The annular intersection 55 between the moat outer wall 51 and the end wall 42 may be slightly rounded, e.g., a 0.010 inch radius, and the outer annular intersection 56 between the end wall 42 and outer annular wall 43 may be well rounded for protection to the shower user, e.g., a radius of 0.030 inch.

In use, the apparatus for producing aerated water may be used in a kitchen sink faucet, or as the preferred embodiment shows, may be in the form of a shower head. The water inlet is at the connector 13 and passes through the central aperture 25 to the restrictor means 32. Due to the apertured disc 33, the water flow is forced to spread out radially in the longitudinal space 40 and is forced through the longitudinally directed apertures 34 in a plurality of longitudinally directed streams of water 60. It is considered that the expansion of the water into the considerably enlarged space defined by the coaxial aperture 36 creates a partial vacuum according to Bernoulli's theorem. This vacuum has been measured along the axis 21 with a sensing probe for a water manometer and found to be about 0.25 inch of water at about the midpoint of the length of the coaxial aperture 36. This, at first, does not appear to be much of a vacuum, yet when one considers that the nozzle 20 is completely open to the atmosphere at the end wall 42, only 0.25 or 0.50 inch away, this small vacuum will cause a considerable inflow of air from the downstream end 42 of the nozzle 20 into the coaxial aperture 36. It is considered that this inflow of air is that which breaks up the water streams into individual water drops 61 so that a soft feel is imparted to the water shower. Also, the restrictor means 32 and the small diameter of the central aperture 25, plus the plug valve 26, cause a reduced water flow to save water.

In the prior art shower heads, the coaxial aperture, similar to aperture 36, extended completely to and was contiguous with the end wall, such as end wall 42, and this end wall was in a plane normal to the axis. In such case, the intersection similar to intersection 53 could not be made a sharp angle of 0.001 inch chamfer or radius, because it would then be so sharp it could be the cause of cutting a person's finger when such person tried to adjust the position of the shower nozzle. Accordingly, it was industry practice to round this corner to a greater extent, at least 0.005 inch radius. Still further, the manufacture of such prior art nozzles was extremely difficult to accomplish without creating any nicks, scratches, or other deformations on this inner annular corner. It was found that any such nick, scratch or deformity could disrupt the water spray pattern and cause the water to flow back along the outside annular surface 43. A number of shower heads were returned to the manufacturer for this very reason as being rejected. The present invention solves this problem by utilizing the annular moat 49 and creating the terminating wall 46, which is recessed longitudinally upstream from the end wall 42. The sharp-angled annular intersection 53 is recessed within the nozzle 20 at about a 120° included conical angle for physical protection of this end wall 46, and more particularly for physical protection to the annular intersection 53. Thus, the annular intersection may be manufactured with a sharp angle, with a chamfer or radius of no greater than 0.001 inch. This achieves a uniform spray pattern, which in this instance is conical at about a 30° included angle, because it has been found that the water drops 61 exit the downstream end of the nozzle 20 at an angle approximately parallel to the angle of the conical extension 45.

In the preferred embodiment, it will be noted that the terminating wall 46 and the end wall 42 are substantially flat, and are normal to the axis 21. Also in this preferred embodiment, the coaxial aperture 36 includes not only the cylindrical boundary wall 44, but the conical extension 45. This is of particular value in a shower head, as distinguished from a kitchen faucet, because this establishes the water drops in a spray pattern which diverges downstream, instead of maintaining a substantially cylindrical spray pattern, as would be the case without the conical extension 45.

The annular moat 49 is defined by the annular outer wall 51, which is approximately twice the longitudinal dimension of the annular moat inner wall 50. In a shower head embodiment of the present invention, the dimensions of the parts were as set forth in Table A.

TABLE A

| | |
|---|---|
| Outside diameter of end wall 42 | 1.00" |
| Diameter of annular intersection 55 | .92" |
| Diameter of annular intersection 54 | .79" |
| Diameter of annular intersection 53 | .76" |
| Diameter of cylindrical wall 44 | .63" |
| Diameter of central aperture 25 | .15" |
| Length of cylindrical wall 44 | .52" |
| Length of conical extension 45 | .27" |
| Included angle of conical extension 45 | 32° |
| Included angle of moat inner wall 50 | 30° |
| Included angle of moat outer wall 51 | 10° |

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. An apparatus for producing aerated water comprising, in combination:

a body having a longitudinal axis and having water inlet and downstream ends;

a coaxial aperture extending to the downstream end of said body;

said body having an annular outer wall surrounding said coaxial aperture;

an end wall of said body contiguous with said outer wall;

a terminating wall at the downstream end of said coaxial aperture recessed upstream from said end wall and facing said downstream end of said coaxial aperture;

said coaxial aperture having a cylindrical boundary wall and merging with a conical extension downstream thereof, said conical extension terminating at said terminating wall and having an included angle of approximately 30°;

an annular moat surrounding said terminating wall and extending between said terminating wall and said end wall;

said terminating wall being a substantially flat surface;

the intersection between said terminating wall and said conical extension being a sharp angle with a radius or chamfer not exceeding 0.003 inch and being physically protected from damage by being recessed upstream from said end wall at about a 120° included conical angle; and restrictor means upstream of said coaxial aperture and having a cross-sectional area for water less than the cross-sectional area of said coaxial aperture to establish a partial vacuum near the downstream end of said coaxial aperture to draw air into said coaxial aperture in a reverse direction from the downstream end of said coaxial aperture to help break up the water emanating from said restrictor means into aerated water.

2. An apparatus as set forth in claim 1, wherein said restrictor means includes an apertured plate to produce plural water streams which become aerated downstream of said apertured plate.

3. An apparatus as set forth in claim 1, wherein said terminating wall is substantially normal to said axis.

4. An apparatus as set forth in claim 1, wherein said end wall is substantially normal to said axis.

5. An apparatus as set forth in claim 1, wherein said restrictor means includes a central aperture in said body and a plate with longitudinally directed apertures therein downstream of said central aperture.

6. An apparatus as set forth in claim 1, wherein said moat includes inner and outer walls, and said outer wall being on the order of twice the longitudinal dimension of said inner wall.

7. An apparatus as set forth in claim 6, wherein the intersection between said moat inner wall and said terminating wall is a sharp angle.

8. An apparatus as set forth in claim 6, wherein said moat inner and outer walls are conical with increasing diameter downstream.

9. An apparatus as set forth in claim 6, wherein said moat includes a bottom wall with a radial dimension less than the longitudinal dimension of said moat inner wall.

10. An apparatus as set forth in claim 1, wherein said moat has an impervious bottom wall.

* * * * *